US006812631B2

(12) United States Patent
Murakami

(10) Patent No.: US 6,812,631 B2
(45) Date of Patent: Nov. 2, 2004

(54) GLASS BULB FOR A CATHODE RAY TUBE AND CATHODE RAY TUBE

(75) Inventor: Toshihide Murakami, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 97 days.

(21) Appl. No.: 10/253,661

(22) Filed: Sep. 25, 2002

(65) Prior Publication Data

US 2003/0062819 A1 Apr. 3, 2003

(30) Foreign Application Priority Data

Sep. 25, 2001 (JP) ..... 2001-291803

(51) Int. Cl.[7] ..... H01J 31/00; H01J 63/02
(52) U.S. Cl. ..... 313/477 R; 220/2.1 A
(58) Field of Search ..... 313/2.1, 477 R, 313/461, 466; 220/2.1 A, 2.3 A; 348/821, 822

(56) References Cited

U.S. PATENT DOCUMENTS

| | | | | |
|---|---|---|---|---|
| 4,571,521 A | | 2/1986 | Gallaro et al. | |
| 5,445,285 A | | 8/1995 | Sugawara et al. | |
| 5,536,995 A | | 7/1996 | Sugawara et al. | |
| 5,925,977 A | | 7/1999 | Sugawara et al. | |
| 5,964,364 A | | 10/1999 | Shimizu et al. | |
| RE36,838 E | | 8/2000 | Sugawara et al. | |
| 6,121,723 A | | 9/2000 | Sugawara et al. | |
| 6,236,151 B1 | | 5/2001 | Murakami et al. | |
| 6,577,055 B1 | * | 6/2003 | Sugawara et al. | 313/477 R |
| 2003/0025590 A1 | * | 2/2003 | Gokcebay et al. | 340/5.73 |
| 2003/0164671 A1 | * | 9/2003 | Sugawara et al. | 313/477 R |

FOREIGN PATENT DOCUMENTS

| | | | | |
|---|---|---|---|---|
| EP | 0 455 918 | | 11/1991 | |
| JP | 7-320661 | | 12/1995 | |
| JP | 2000-149820 | | 5/2000 | |
| JP | 2000-251766 | | 9/2000 | |
| JP | 2003123671 A | * | 4/2003 | C03B/23/09 |
| WO | WO 00/68969 | | 11/2000 | |

* cited by examiner

*Primary Examiner*—Nimeshkumar D. Patel
*Assistant Examiner*—Karabi Guharay
(74) *Attorney, Agent, or Firm*—Oblon, Spivak, McClelland, Maier & Neustadt, P.C.

(57) ABSTRACT

A glass bulb for a cathode ray tube includes a panel and a funnel sealed to each other at respective seal edge portions to form a sealing portion. The panel includes a face portion with a substantially rectangular screen, and a skirt portion constituting a sidewall of the face portion and having a seal edge portion at its end. The funnel is connected to a cylindrical neck portion for housing an electron gun. A distance H from the center of the inner surface of the face portion to a point where a reference line of the funnel crosses the bulb's central axis, and the diagonal length D of the screen, satisfy D/H≧3.3. A bent portion bending towards the bulb's central axis is provided at least on a long side of the sealing portion.

5 Claims, 6 Drawing Sheets

GLASS BULB FOR A CATHODE RAY TUBE AND CATHODE RAY TUBE

CROSS-REFERENCE TO RELATED APPLICATION

The entire disclosure of Japanese Patent Application No. 2001-291803 filed on Sep. 25, 2001, the foreign priority Application, including specification, claims, drawings and summary is incorporated herein by reference in its entirety.

BACKGROUND OF THE INVENTION

1. Field of the Invention

The present invention relates to a glass bulb for a cathode ray tube to be used for e.g. a display for a television broadcast receiver (hereinafter referred to as a television) or a computer, and to a cathode ray tube employing said bulb.

2. Description of Related Art

A face portion 5 of a cathode ray tube has a substantially rectangular shape as illustrated in FIG. 10, as viewed from the direction of the tube axis 19 (arrow A in FIG. 2), and has two long sides 21 and two short sides 22. Further, the axis passing through the center 23 of the face portion 5 in parallel with the long sides 21, is referred to as the long axis 24, and the axis in parallel with the short sides 22 is referred to as the short axis 25.

As illustrated in FIG. 11, the panel 2, like the face portion 5, has four sides comprising two long sides 30 and two short sides 31 at its seal edge portion 7, and its outer profile has a shape substantially the same as the profile of the face portion 5.

Further, as illustrated in FIG. 12, the seal edge portion 8 of the funnel 3 likewise has two long sides 32 and two short sides 33, and has a shape substantially congruent with that of the seal edge portion 7 of the panel 2, as described above. Then, the seal edge portion 7 of the panel 2 and the seal edge portion 8 of the funnel 3 are joined and sealingly bonded by means of e.g. a solder glass, to form a sealing portion 34 (shown in FIG. 2).

In the cathode ray tube having a construction as described above in detail, inside of the bulb 1 is maintained to be in high vacuum in order to have the electron beam radiated to display picture images. However, the bulb 1 having an asymmetrical shape, as is different from a spherical shell, is loaded with a pressure difference of 1 atm between its inside and outside, whereby it is in an unstable state due to a high strain energy thus formed. Therefore, even when a very small crack is formed in the glass constituting the panel 2 or the funnel 3, it is likely that the crack grows to release the strain energy, which may lead to a destruction. Further, when a high tensile stress is formed on the outer surface of the panel 2 or the funnel 3, a delayed fracture may take place due to the effect of moisture in the atmosphere, which may cause decrease in the reliability of the cathode ray tube.

In recent years, liquid crystal displays and plasma displays have been developed and put into practical use, and when these are compared with a display employing a cathode ray tube, the large depth of the cathode ray tube is regarded as a demerit. Therefore, it has been tried to reduce the depth (the length in the direction of the tube axis 19) of a bulb to be employed in cathode ray tubes, and as a result, the asymmetricity of the shape of the bulb has further increased and the tensile stress formed on the outer surface of the bulb has increased.

The body portion 9 of the funnel 3 is formed to have a substantially truncated pyramid shape which has a large opening towards the panel 2, and accordingly, when the inside of the bulb 1 is vacuumed, the body portion 9 tends to be deformed as it is depressed towards the panel 2 in the direction of the tube axis 19. And, the face portion 5 of the panel 2, is formed to be most flat in the bulb 1 in order to display picture images, and thus is very likely to be deformed, and tends to be deformed so as to be depressed towards the funnel 3 in the direction of the tube axis 19. As a result, to the sealing portion 34 and the skirt portion 6 continuous therefrom, a force will be exerted to expand them outward (in the direction departing from the tube axis 19).

FIG. 13 shows an example of the distribution of the stress formed on the outer surface of the bulb 1. Here, when the distribution curve (indicated by a chain double-dashed line in the FIG.) is outside of the profile of the bulb 1, it indicates that a tensile stress is formed, and when the distribution curve is inside of the profile of the bulb 1, it indicates that a compressive stress is formed.

The left half of the solid line in FIG. 13 represents the outer profile line of the cross section when the bulb is cut along the long axis 24, and its right half represents the outer profile line of the cross section when the bulb is cut along the short axis 25. Further, in the following description, the tensile stress formed on the bulb surface when its inside is vacuumed, will be referred to as a "tensile vacuum stress".

As illustrated in FIG. 13, a high tensile vacuum stress is formed at the end of the face portion 5 of the panel 2 and at the body portion 9 of the funnel 3. Accordingly, on the outer surface of the sealing portion 34 where the seal edge portion 7 of the panel 2 and the seal edge portion 8 of the funnel 3 are bonded, strains formed on both the panel 2 and the funnel 3, are propagated and concentrated to form an extremely high tensile vacuum stress. Especially, at the end portions of the short axis 25 of the face portion 5, namely in the vicinity of the center portions of the long sides 21, a high tensile vacuum stress is formed.

As a result, it may cause lowering of the safety due to destruction of the cathode ray tube, or lowering of the reliability due to the delayed fracture caused by moisture in the atmosphere. Further, if the wall thickness of the glass of the body portion 9 or of the seal edge portions 7 and 8, is increased in order to solve the problem of such a high tensile vacuum stress, there will be a problem of an increase of the mass, which is a major demerit for a cathode ray tube, as well as the problem of the depth.

It is an object of the present invention to prevent the increase of the tensile vacuum stress formed at the sealing portion without increasing the wall thickness of the glass at the body portion of the funnel or at the sealing portion of the panel and the funnel, and thereby to provide a glass bulb for a cathode ray tube, being light in weight and having a small depth and high safety, and to provide a cathode ray tube employing such a bulb.

SUMMARY OF THE INVENTION

FIG. 2 is a schematic view illustrating the cross section of a cathode ray tube. The cathode ray tube employs a glass bulb (hereinafter, a glass bulb for a cathode ray tube will be referred to simply as "a bulb") 1 as an envelope, and the bulb 1 is constituted by a panel 2 and a funnel 3. The panel 2 comprises a face portion 5 having a screen 4 for displaying picture images, and a skirt portion 6 constituting a sidewall of the face portion 5. The skirt portion 6 has a seal edge portion 7 at its end.

Further, the funnel 3 has a seal edge portion 8 having a shape substantially congruent with the shape of the seal edge portion 7 of the panel 2, and the other opening portion is connected to a cylindrical neck portion 10, and a yoke portion 11 is integrally connected between the body portion 9 and the neck portion 10 to form a substantially funnel shape.

An electron gun 12 is housed in the neck portion 10, and an electron beam radiated from the electron gun 12 is deflected by a deflecting yoke 13 put around the yoke portion 11, and lets a phosphor screen 14 emit a light.

Besides these, an aluminum film 15 for reflecting the light emitted from the phosphor screen 14 forward, a shadow mask 16 for regulating the position of electron beam irradiation on the phosphor screen 14, stud pins 17 for fixing the shadow mask 16 to the inside of the panel 2, and an anode button 18 for preventing high electrostatic potential of the shadow mask 16 due to the electron beam and for conductive earthing to the outside, are, for example, provided. The seal edge portion 7 of the panel 2 and the seal edge portion 8 of the funnel 3 are sealingly bonded to each other. Further, the chain line 19 in FIG. 2 indicates the tube axis connecting the central axis of the neck portion 10 and the center of the face portion 5.

Further, the chain double-dashed line 20 in FIG. 2 indicates the reference line of the bulb 1. The reference line 20 means one defined as "an imaginary base line perpendicular to the tube axis of a funnel yoke portion, defined by means of a reference line gauge" in Japan Electronics and Information Technology Industries Association (JEITA) standard ED-2134B.

To solve the above-mentioned problems, the present invention provides a glass bulb for a cathode ray tube, comprising a panel and a funnel sealed to each other at the respective seal edge portions to form a sealing portion; wherein said panel comprises a face portion having a substantially rectangular screen, and a skirt portion constituting a sidewall of the face portion and having a seal edge portion at its end;

said funnel has a seal edge portion having a shape substantially congruent with the seal edge portion of said panel, as an opening portion of its body portion, and the other opening portion is connected to a cylindrical neck portion for housing an electron gun, and a yoke portion is integrally connected between said body and neck portions to form a substantially funnel shape;

when a straight line in parallel to the central axis of said neck portion, passing through the center of the inner surface of said face portion, is designated as the bulb's central axis, then the distance H from the center of the inner surface of said face portion to a point where the reference line of the funnel crosses the bulb's central axis, and the diagonal length D of said screen, satisfy $D/H \geqq 3.3$; and in said sealing portion having a substantially rectangular cross sectional shape in the direction perpendicular to the bulb's central axis, a bent portion bending towards the bulb's central axis, is provided at least on a long side of the sealing portion.

In the bulb of the present invention, it is preferred that, among four sides of said sealing portion having a substantially rectangular cross section, when the side having a bent portion is designated as a bent side, the center of the bent portion and the center of the bent side are substantially at the same position, and the length $L_f$ of the bent portion in the direction of the bent side is at least a half of the length L of the bent side.

Further, in the bulb of the present invention, it is preferred that, when a point at one third of the height of the body portion from the center of a side of the sealing portion, in the direction perpendicular to said side towards the neck portion, is designated as a body portion's end vicinity point, and the central position of the skirt portion of the panel facing and sealed with said body portion, is designated as a skirt portion's central point, then at least a region between said body portion's end vicinity point and said skirt portion's central point, is the bent portion bending towards the bulb's central axis.

The present invention further provides the glass bulb for a cathode ray tube, having the above-mentioned construction, wherein said funnel is provided with a plurality of the yoke and neck portions.

The present invention still further provides a cathode ray tube employing the above-mentioned glass bulb for a cathode ray tube.

BRIEF DESCRIPTION OF THE DRAWINGS

In the accompanying drawings:

FIG. 4(*b*) is a schematic view illustrating a relation between the force exerted to a cylindrical curvature and the deformation, wherein the force is exerted in the opposite direction to the curvature.

DESCRIPTION OF THE PREFERRED EMBODIMENTS

Now, the bulb of the present invention will be described in detail.

Figure 1:
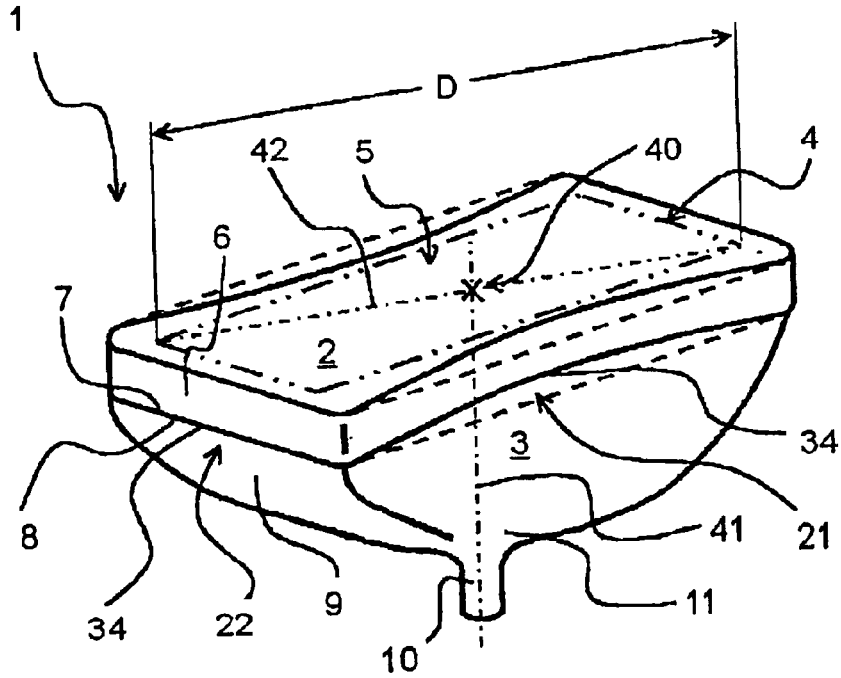
FIG. 1 is a view illustrating the bulb of the present invention.

As illustrated in FIG. 1, the bulb 1 of the present invention, like a conventional bulb, comprises a panel 2 and a funnel 3 sealed to each other at the respective seal edge portions to form a sealing portion 34. Said panel 2 comprises a face portion 5 having a substantially rectangular screen 4, and a skirt portion 6 constituting a sidewall of the face portion 5 and having a seal edge portion 7 at its end. Said funnel 3 has a seal edge portion 8 having a shape substantially congruent with the seal edge portion 7 of said panel 2, as an opening portion of its body portion 9, and the other opening portion is connected to a cylindrical neck portion 10 for housing an electron gun, and a yoke portion 11 is integrally connected between the body portion 9 and the neck portion 10 to form a substantially funnel shape. Here, the screen 4 is also referred to as an effective screen, and means a picture image area where images are displayed, and it is a substantially rectangular area defined by the chain double-dashed line as shown in FIG. 1.

Further, in the present invention, a straight line being in parallel with the central axis of the neck portion 10 and passing through the center 40 of the inner surface of the face portion, is designated as the bulb's central axis 41, and the length of a diagonal line 42 in the substantially rectangular screen 4, is designated as D. Here, in the case of a bulb 1 employing a usual funnel 3 provided with a pair of the yoke portion 11 and the neck portion 10, the tube axis and the bulb's central axis 41 become the same. In the present invention, the cross-sectional shape of the yoke portion 11 in the direction perpendicular to the bulb's central axis 41, may be circular or non-circular such as substantially rectangular.

Figure 2:
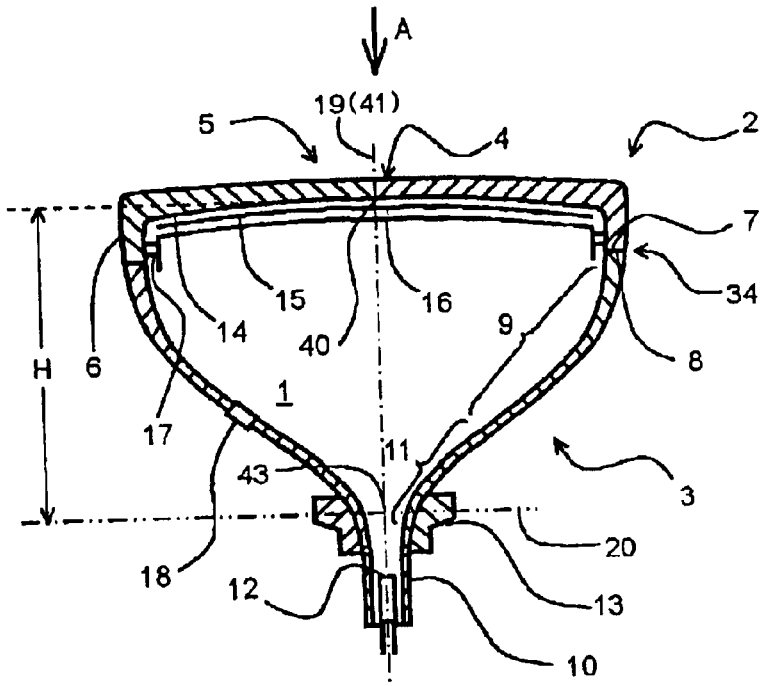
FIG. 2 is a cross-sectional view illustrating the structure of a cathode ray tube.

Further, as illustrated in FIG. 2, when the distance from the center of the inner surface of the face portion 5 to the point 43 where the reference line 20 of the funnel 3 crosses the bulb's central axis 41, is designated as H, then the relation $D/H \geqq 3.3$ is satisfied in the bulb of the present invention. If the value of D/H is smaller than 3.3, the screen is small in relation to the depth of the bulb, and in other words, the bulb has a large depth in relation to the area of the screen.

Figure 3:
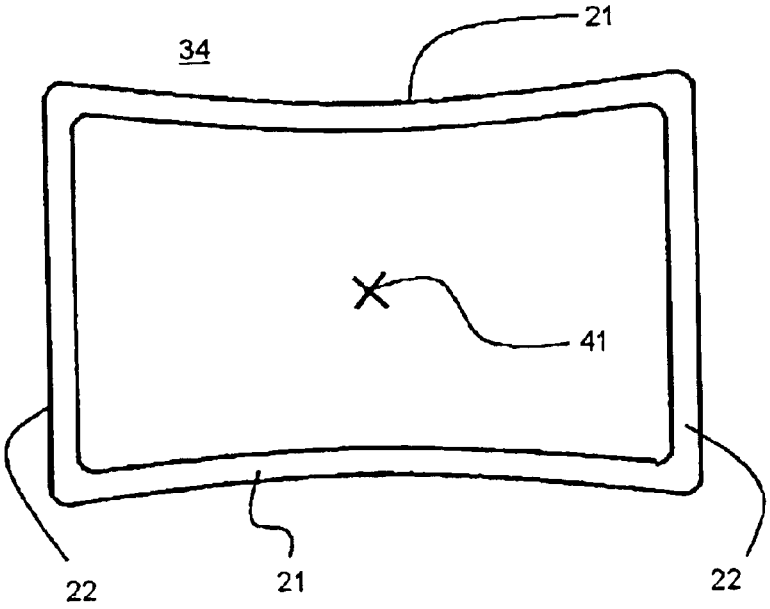
FIG. 3 is a view illustrating a cross section of the sealing portion of the bulb of the present invention.

In addition, the bulb of the present invention is also characterized in that in the sealing portion having a substantially rectangular cross section in the direction perpendicular to the bulb's central axis 41 (19), at least on each long side 21 of the sealing portion 34, a bent portion bending in a direction towards the bulb's central axis 41 (hereinafter referred to as an "inward direction") is provided. FIG. 3 shows a cross-sectional view when the bulb is cut in a direction (plane) perpendicular to the bulb's central axis 41, passing through the sealing portion 34.

As mentioned above, in a conventional bulb, the highest tensile vacuum stress is formed at the sealing portion, whereby a force for deformation will be exerted to expand it outward (in a direction departing from the bulb's central axis 41). This phenomenon is particularly remarkable at the long sides 21. Therefore, in the bulb of the present invention, among four sides constituting the cross section of the sealing portion 34, at least the long sides 21 are respectively provided with a bent portion bending in the inward direction. Thus, by imparting a rigidity sufficient to resist the force for deformation to expand the sealing portion 34 in the outward direction, it becomes possible to suppress the formation of the tensile vacuum stress on the outer surface of the sealing portion 34.

In FIG. 3, each short side 22 is illustrated to be linear, but it may be provided with a bent portion bending outward i.e. in the outward direction (a direction departing from the bulb's central axis 41), or on the contrary, it may be provided with a bent portion bending in the inward direction in the same manner as the long side. In the latter case where the sealing portion has a shape where a bent portion bending in the inward direction is provided on each of the four sides, it becomes possible to reduce the high tensile stress generated both on the long sides and on the short sides, such being more preferred.

Figure 4A:
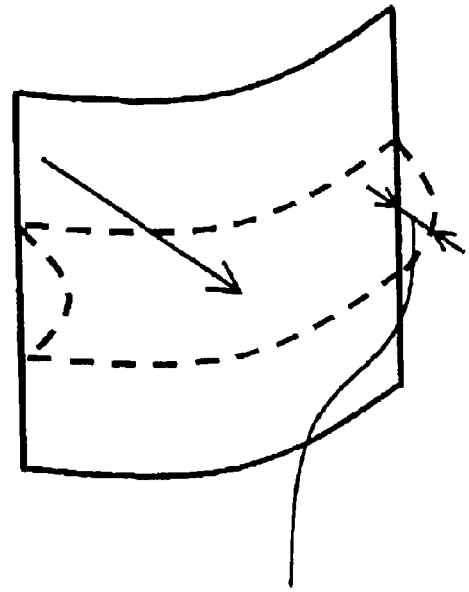
FIG. 4(*a*) is a schematic view illustrating a relation between the force exerted to a cylindrical curvature and the deformation, wherein the force is exerted in the same direction as the curvature.
Figure 4B:
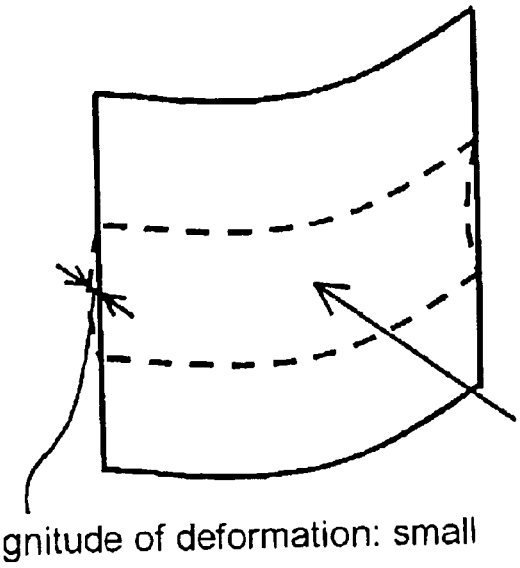

As illustrated in a perspective view of the bulb in FIG. 1, a region from the skirt portion 6 of the panel 2 through the sealing portion 34 to its vicinity in the body portion 9 of the funnel 3, has a shape similar to a part of a cylindrical surface, and has a convex surface bending in the inward direction. Such a curved surface has a characteristic that, as illustrated in FIGS. 4(*a*) and 4(*b*), it is easily deformed when a force is exerted in the same direction as the bending direction (FIG. 4(*a*)), but it is not easily deformed when the force is exerted in the opposite direction to the bending direction (FIG. 4(*b*)). Therefore, by making a bent surface having a curvature bending in the inward direction at the sealing portion 34 and in its vicinity where a high strain energy for expanding them in the outward direction is formed, it becomes possible to ease the effect of deforming formed at the sealing portion 34 and in its vicinity, and to reduce the tensile stress at the sealing portion 34.

Figure 5:
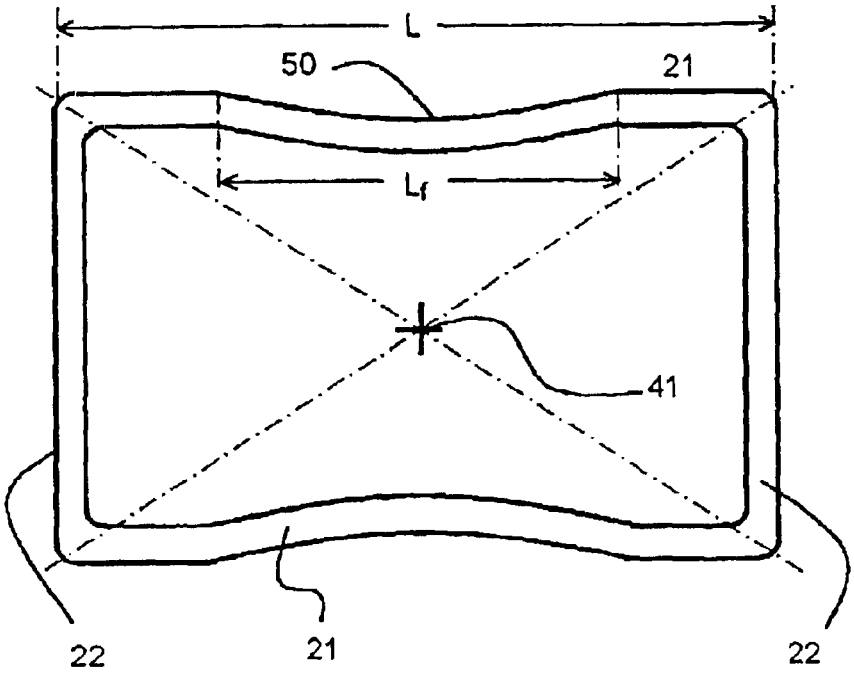
FIG. 5 is a view illustrating a cross section of the sealing portion of the bulb of the present invention.

FIG. 3 shows a sealing portion having a bent portion extending over the entire length of each long side, but it may be one having a bent portion extending only a part of the length of each long side. Here, as shown in FIG. 5, when the length of a side (bent side) having the bent portion formed at a part thereof, namely the length of the long side 21 in this example, is designated as L, and the length of the bent portion 50 in the direction of the bent side (in the direction of the long side) is designated as $L_f$, then the $L_f$ is preferably at least a half of L. When $L_f/L$ is less than a half, the above-mentioned effect of lowering the tensile stress cannot be obtained over the entire area where the high tensile stress is formed.

Here, the center of the bent side (long side 21) and the center of the bent portion 50 are preferably at the same position. If the center of the bent side (long side 21) and the center of the bent portion 50 are at different positions from each other, the bent portion 50 is present as displaced to one side on the bent side (long side 21), which will cause formation of an unnecessary tensile vacuum stress as displaced.

In the same manner, the bending surface can sufficiently exhibit its effect when it extends also in the direction of bulb's central axis to have a certain area. Accordingly, it is preferred that the bent portion bending in the inward direction is formed to cover a region from a point in the vicinity of the upper end (the sealing portion) of the body portion of the funnel 3, to the center in the height of the skirt portion. Here, the above-mentioned "point in the vicinity of the upper end (the sealing portion) of the body portion" will be referred to as the "body portion's end vicinity point" which will be defined as follows.

Figure 6:
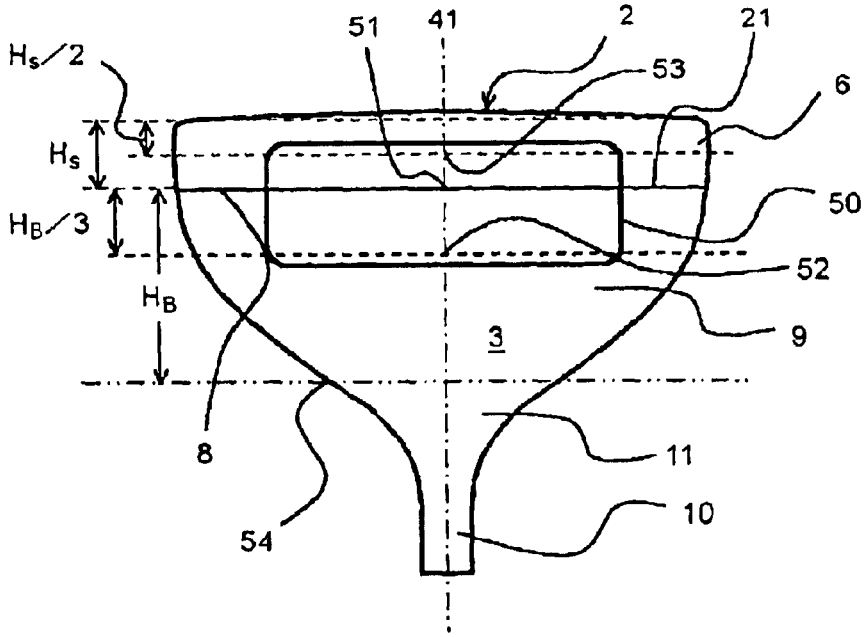
FIG. 6 is a view illustrating the side surface of the bulb of the present invention.

Firstly, as illustrated in FIG. 6, a point at one third ($H_B/3$) of the height $H_B$ of the body portion 9 from the center 51 of a side of the sealing portion, namely a bent side (long side 21) having a bent portion 50 in this case, in the direction perpendicular to said side towards the neck portion 10, is designated as a body portion's end vicinity point 52. Further, the central position of the skirt portion 6 of the panel 2 facing and sealed with said body portion 9, is designated as a skirt portion's central point 53. Then, in the bulb of the present invention, it is preferred that at least a region between said body portion's end vicinity point 52 of the funnel 3 and said skirt portion's central point 53 of the panel 2, is the bent portion 50 bending towards the bulb's central axis 41.

Figure 7:
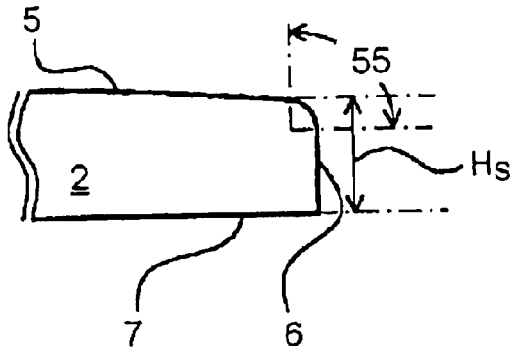
FIG. 7 is a view for illustrating the definition of the height of the skirt portion.

Here, the height $H_B$ of the body portion 9 means the height from the seal edge portion 8 of the funnel 3 to the yoke end 54, in a direction in parallel with the bulb's central axis 41 (tube axis 19). The yoke end 54 means a point corresponding to an inflection point of the curve forming the outer surface of the funnel, and in the case of a funnel comprising a yoke portion having a circular cross section, the yoke end 54 is a point which is commonly referred to as "TOP OF ROUND" or "SHINENTAN" by persons skilled in the art. Further, the skirt portion's central point 53 means, as illustrated in FIG. 6 and FIG. 7, the center of a substantially rectangular shape having a short side being a height HS from the seal edge portion 7 of the panel 2 to the face portion 5 side end of a blend 55, in the direction of the bulb's central axis 41 (tube axis 19), and having a long side being the width in the direction of the long side of the skirt portion. Thus, by making the bent portion 50 have a certain range in the direction of bulb's central axis 41, the stress formed in the sealing portion 34 can further be reduced.

The above description of the bent portion 50 has been made with respect to one having a partial cylindrical shape having a circular arcuate cross section. However, the bent portion may not always have to have such a shape, and it may be a bent portion having a changing curvature radius, or a substantially wedge-shaped bent portion. The bent shape can be selected appropriately depending on the design purpose in consideration of various conditions such as assembling of television sets, so long as the bent portion is one bending in the inward direction and having a substantially uniform wall thickness.

Figure 8:
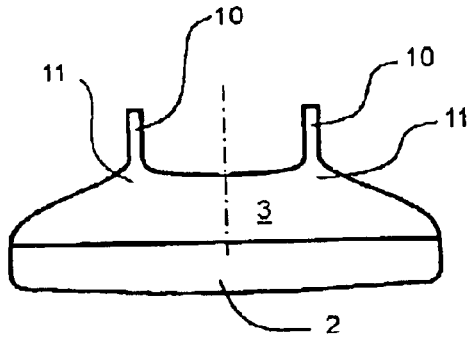
FIG. 8 is a view illustrating an example of a bulb provided with two pairs of yoke and neck portions.

Further, as illustrated in FIG. 8, a bulb may be constituted by employing a funnel 3 provided with a plurality of neck and yoke portions 10 and 11, whereby further reduction of the depth becomes possible. FIG. 8 illustrates an example of the funnel 3 provided with two pairs of the neck and yoke portions 10 and 11, but it is not limited to this example, and may be one having three pairs or more.

Further, the present invention can be easily applied to a bulb having a unique shape which did not exist before, such as JP-A-2000-251766 published by the present applicant. Accordingly, various synergistic effects may be obtained.

According to the above-mentioned invention, a glass bulb for a cathode ray tube, being light in weight and having a small depth and high safety, and a cathode ray tube employing said bulb, can be provided.

Now, the present invention will be described specifically with reference to Examples based on the present invention and Comparative Examples. Here, each of the panels employed in the bulbs as described hereinafter, is one for 36-inch television, employing glass material 5008, manufactured by Asahi Glass Company, Limited, having an aspect ratio of 16:9, a face portion outer surface curvature radius of 100,000 mm, an effective screen diagonal conjugate diameter of 860 mm and a panel outermost diagonal conjugate diameter of 921.6 mm. Each of the funnels is one employing glass material 0138 manufactured by Asahi Glass Company, Limited.

Further, the shapes and dimensions are adjusted so that the maximum tensile vacuum stress formed at the sealing portion becomes 7.5 MPa, when a bulb comprising the above-mentioned panel and funnel sealingly bonded, is evacuated to make the inside of the bulb in vacuum. Here, the stress measurement is performed by attaching a strain gauge KFG-5-120-D16-11 manufactured by Kyowa Electronic Instruments Co., Ltd.

EXAMPLE 1

Present Invention

As illustrated in FIG. 5, a bent portion bending in the inward direction was provided at a part of each long side of the sealing portion. At that time, the curvature radius of the bent portion was 5,450 mm, and the relation between the length L of the long side and the length $L_f$ was $L_f/L=0.85$. Further, when the curvature radius is identified by − (negative) when the bending of the long side is convex in the inward direction, and the curvature radius is identified by + (positive) when the bending is convex in the outward direction, then the mean curvature diameter was −12030 mm.

EXAMPLE 2

Present Invention

As illustrated in FIG. 3, the entire length of each of the long sides of the sealing portion was made to be a bent portion bending in the inward direction. At that time, the curvature radius of the bent portion was −9980 mm, the relation between the length L of the long side and the length $L_f$ of the bent portion was $L_f/L=1.0$.

EXAMPLE 3

Present Invention

Figure 9:
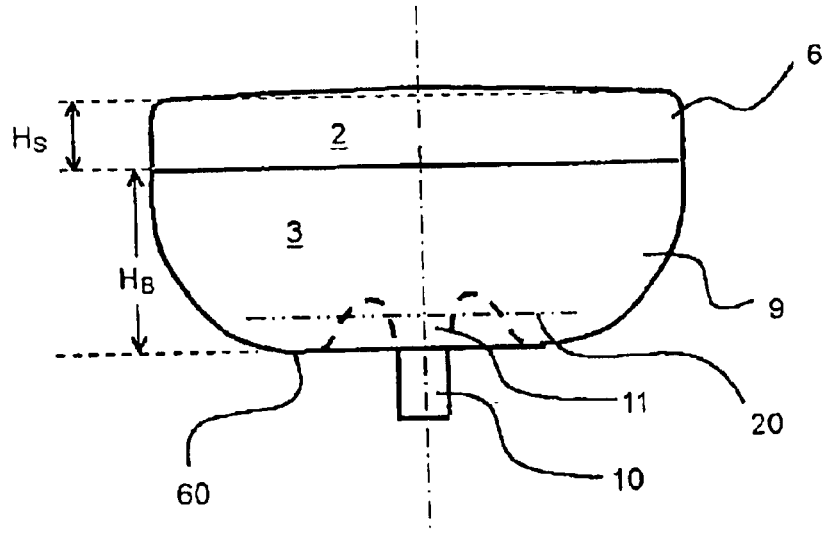
FIG. 9 is a view illustrating the bulb in Example 3 of the present invention.
Figure 10:
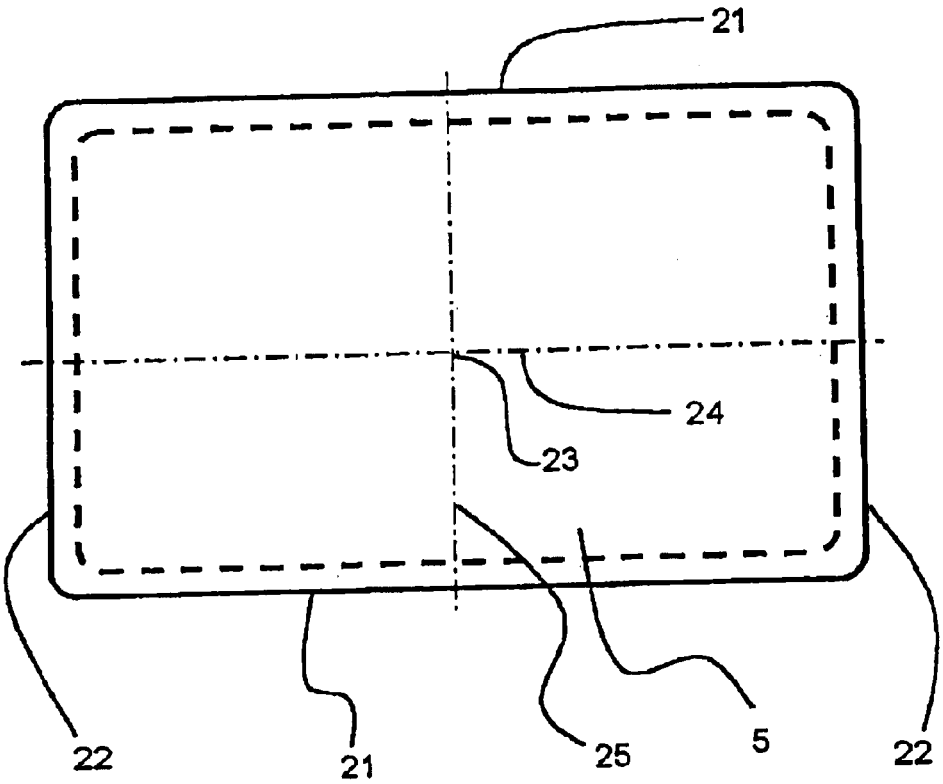
Fig. 10 BACKGROUND ART
FIG. 10 is a plan view illustrating the face portion of a common panel.
Figure 11:
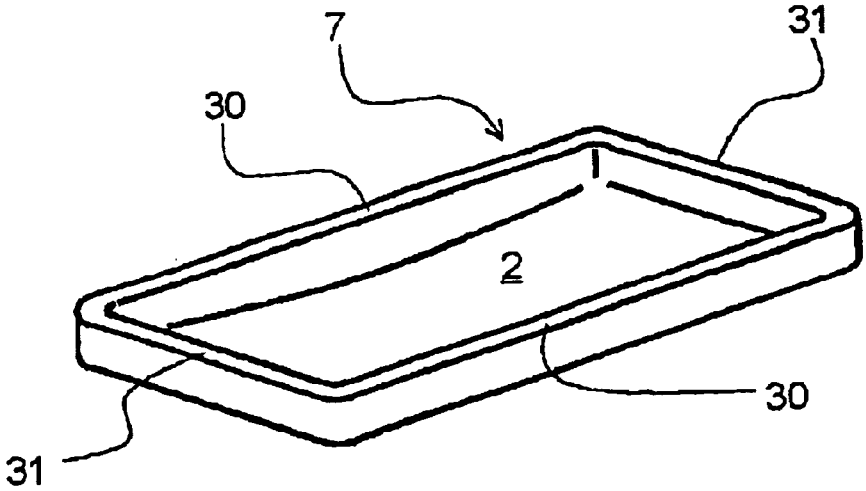
Fig. 11 BACKGROUND ART
FIG. 11 is a view illustrating a common panel.
Figure 12:
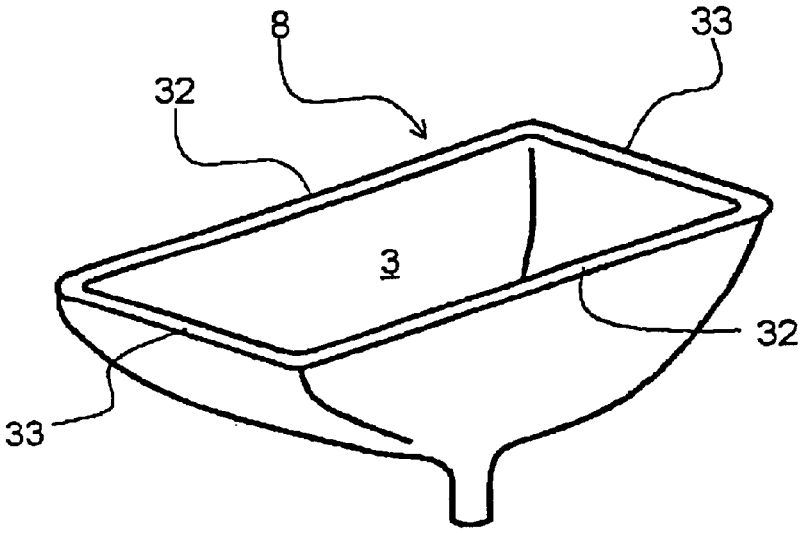
Fig. 12 BACKGROUND ART
FIG. 12 is a view illustrating a common funnel.
Figure 13:
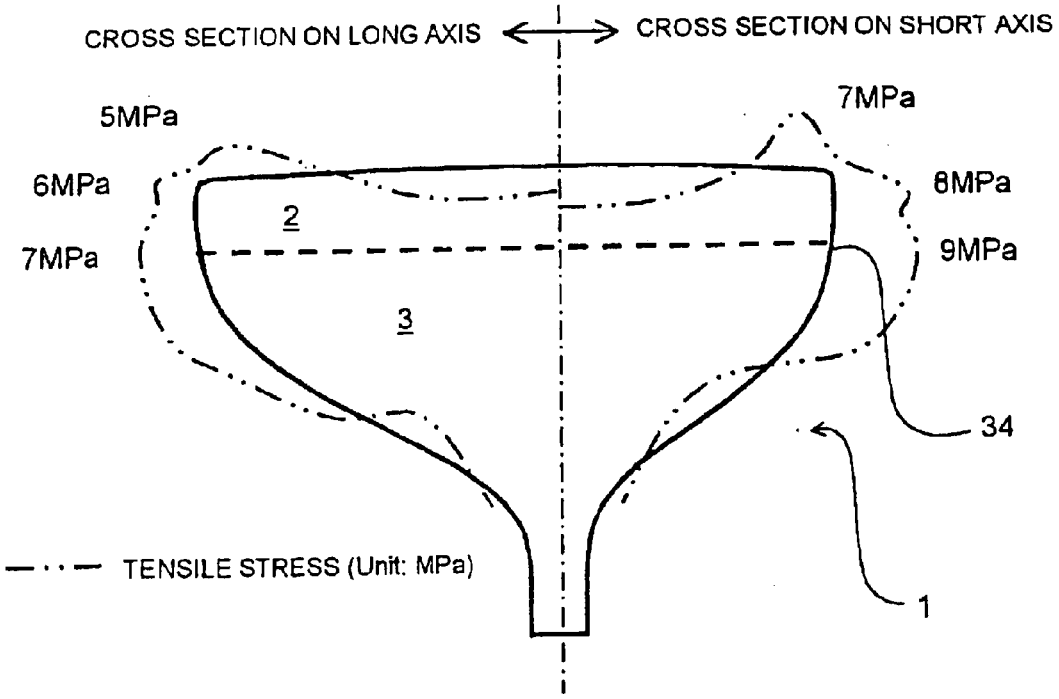
Fig. 13 BACKGROUND ART
FIG. 13 is a view illustrating the distribution of the tensile stress formed in a common bulb.

As illustrated in FIG. 9, the yoke portion to be provided with a deflecting yoke, was made to have a shape caved in towards the panel, and like Example 2, the sealing portion was formed so that the entire length of each of its long sides was bent in the inward direction. Here, the body portion height $H_B$ in this case was defined to be a height from the seal edge portion 8 of the funnel 3 to the most protruded end 60 on the yoke portion side of the body portion, in the direction of bulb's central axis.

EXAMPLE 4

Comparative Example

A conventional common bulb having no bent portion was prepared by employing a panel and a funnel designed and manufactured to have known shapes, respectively.

EXAMPLE 5

Comparative Example

A bulb was made so that no bent portion was formed at any portion, and the glass wall thickness in each portion was made thicker than in Example 4, so that the increase of the tensile vacuum stress formed at the sealing portion was thereby prevented and the oblateness was thereby increased to obtain the same depth as Example 1.

The dimensions and various types of measured values of the respective portions of the bulbs in Examples 1 to 5 are shown below. Here, the respective symbols have the following meanings.

$R_A$: aspect ratio of effective screen

D: diagonal conjugate diameter (mm) of screen $D_{max}$: outermost diagonal conjugate diameter (mm) of panel $H_S$: height (mm) of skirt portion $T_{fc}$: center wall thickness (mm) of face portion $C_{fp}$: curvature radius (mm) of outer surface of face portion $T_{se}$: wall thickness (mm) of sealing portion H: distance (mm) from reference line to the center of face portion's inner surface D/H: oblateness $H_B$: height (mm) of body portion $C_{ave}$: average curvature radius (mm) of bent side (long side of sealing portion)

Here, when the value is positive, the curvature is in the outward direction, and when the value is negative, the curvature is in the inward direction.

L: length (mm) of bent side (long side of sealing portion)

$L_f$: length (mm) of bent portion $H_{sf}$: height (mm) from the bent portion's point closest to blend R, in panel's skirt portion, to seal edge portion in the direction of bulb's central axis $H_{Bf}$: height (mm) from the bent portion's point closest to yoke portion, in funnel's body portion, to seal edge portion in the direction of bulb's central axis $H_E$: depth (mm) of bulb $T_B$: wall thickness (mm) of body portion at a point 80 mm from the center of long side of sealing portion towards yoke portion along the wall in the direction perpendicular to the long side $M_B$: bulb mass (kg)

$\sigma_{SEmax}$: maximum tensile vacuum stress (MPa) formed at sealing portion

TABLE 1

| | Ex. 1 | Ex. 2 | Ex. 3 | Ex. 4 | Ex. 5 |
|---|---|---|---|---|---|
| $R_A$ | 16:9 | 16:9 | 16:9 | 16:9 | 16:9 |
| D | 860.0 | 860.0 | 860.0 | 860.0 | 860.0 |
| $D_{max}$ | 921.6 | 921.6 | 921.6 | 921.6 | 921.6 |
| $H_s$ | 110.0 | 110.0 | 98.5 | 115.0 | 110.0 |
| $T_{fc}$ | 17.5 | 17.0 | 23.5 | 20.0 | 20.0 |
| $C_{fp}$ | 100000 | 100000 | 100000 | 100000 | 100000 |
| $T_{se}$ | 13.0 | 13.0 | 12.0 | 13.5 | 14.0 |
| H | 263.2 | 263.2 | 208.5 | 350.0 | 263.2 |
| D/H | 3.3 | 3.3 | 4.1 | 2.5 | 3.3 |
| $H_B$ | 136.0 | 136.0 | 160.0 | 225.0 | 136.0 |
| $C_{ave}$ | −12030 | −9980 | −9970 | 6240 | 7690 |
| L | 732 | 732 | 732 | 746 | 746 |
| $L_f$ | 624 | 732 | 732 | | |
| $L/L_f$ | 0.85 | 1.0 | 1.0 | | |
| $H_{Sf}$ | 55.0 | 110.0 | 98.5 | | |
| $H_{Sf}/H_S$ | 0.5 | 1.0 | 1.0 | | |
| $H_{Bf}$ | 54.4 | 68.0 | 60.8 | | |
| $H_{Bf}/H_B$ | 0.4 | 0.5 | 0.4 | | |
| $H_E$ | 440.0 | 440.0 | 366.00 | 538.0 | 440.0 |
| $T_B$ | 9.5 | 9.5 | 10.0 | 8.5 | 10.5 |
| $M_B$ | 54.0 | 53.5 | 53.1 | 54.2 | 56.8 |
| $\sigma_{SEmax}$ | 7.5 | 7.5 | 7.5 | 7.5 | 7.5 |

According to the results shown above, in the bulb in Example 1, by providing a bent portion bending in the inward direction at least at a part of each long side (85% of the long side length), the maximum tensile vacuum stress $\sigma_{SEmax}$ formed in the sealing portion could be maintained to be 7.5 MPa being the same as in the bulb in Example 4 having a conventional shape, even if the face portion center's wall thickness $T_{fc}$ and the sealing portion's wall thickness $T_{se}$ were reduced. As a result, the distance H from the reference line to the center of the face portion's inner surface could be reduced by 86.8 mm to improve the oblateness D/H, and the depth of the bulb $H_E$ could be reduced by 98 mm. Further, the mass could also be reduced by 0.9% as compared with Example 4.

In the bulb of Example 2, each of the long sides was made to be a bent portion over its entire length bending in the inward direction, and the area of the bent portion in the direction of bulb's central axis was widened, and consequently, the maximum tensile vacuum stress $\sigma_{SEmax}$ formed in the sealing portion could be maintained to be 7.5 MPa being the same as in the bulb in Example 4, even if the wall thickness at the center of the face portion was reduced as compared with Example 1. As a result, the mass could be reduced by 1.3% as compared with Example 4.

In the bulb of Example 3, each of the long sides was made to be a bent portion over its entire length bending in the inward direction, and the yoke portion to be provided with a deflecting yoke was made to have a shape caved in towards the panel, and consequently, the maximum tensile vacuum stress $\sigma_{SEmax}$ formed at the sealing portion could be maintained to be 7.5 MPa being the same as in the bulb in Example 4, even if sealing portion's wall thickness $T_{se}$ was reduced. As a result, the distance H from the reference line to the center of the face portion's inner surface could be reduced by 141.5 mm to improve the oblateness D/H, and the depth $H_E$ of the bulb could be reduced by 172 mm. Further, the mass could also be reduced by 2.0% as compared with Example 4.

In the bulb of Example 5 in which it was attempted to achieve a low oblateness by preventing the increase of the tensile vacuum stress formed at the sealing portion by increasing glass wall thickness, the wall thickness $T_{se}$ of the sealing portion was obliged to be increased by 3.7% as compared with Example 4, and accordingly, the mass was also increased by 4.8% as compared with Example 4.

The glass bulb for cathode ray tubes and the cathode ray tube of the present invention, are constructed as described above, whereby they can exhibit an effect that a space saving by reducing the depth and weight reduction can be achieved at the same time. Further, the increase of the tensile vacuum stress formed at the sealing portion can be prevented, whereby they also exhibit an effect that the safety will not be impaired.

What is claimed is:

1. A glass bulb for a cathode ray tube, comprising a panel and a funnel sealed to each other at the respective seal edge portions to form a sealing portion; wherein said panel comprises a face portion having a substantially rectangular screen, and a skirt portion constituting a sidewall of the face portion and having a seal edge portion at its end;

said funnel has a seal edge portion having a shape substantially congruent with the seal edge portion of said panel, as an opening portion of its body portion, and the other opening portion is connected to a cylindrical neck portion for housing an electron gun, and a yoke portion is integrally connected between said body and neck portions to form a substantially funnel shape;

when a straight line in parallel to the central axis of said neck portion, passing through the center of the inner surface of said face portion, is designated as the bulb's central axis, then the distance H from the center of the inner surface of said face portion to a point where the reference line of the funnel crosses the bulb's central axis, and the diagonal length D of said screen, satisfy $D/H \geqq 3.3$; and in said sealing portion having a substantially rectangular cross sectional shape in the direction perpendicular to the bulb's central axis, a bent portion bending towards the bulb's central axis, is provided at least on a long side of the sealing portion.

2. The glass bulb for a cathode ray tube, according to claim 1, wherein among four sides of said sealing portion having a substantially rectangular cross section, when the side having a bent portion is designated as a bent side, the center of the bent portion and the center of the bent side are at substantially the same position, and the length $L_f$ of the bent portion in the direction of the bent side is at least a half of the length L of the bent side.

3. The glass bulb for a cathode ray tube, according to claim 1, wherein, when a point at one third of the height of the body portion from the center of a side of the sealing portion, in the direction perpendicular to said side towards the neck portion, is designated as a body portion's end vicinity point, and the central position of the skirt portion of the panel facing and sealed with said body portion, is designated as a skirt portion's central point, then at least a region between said body portion's end vicinity point and said skirt portion's central point, is the bent portion bending towards the bulb's central axis.

4. The glass bulb for a cathode ray tube, according to claim 1, wherein said funnel is provided with a plurality of the yoke and neck portions.

5. A cathode ray tube employing the glass bulb for a cathode ray tube, as defined in claim 1.

* * * * *